US009373280B2

(12) United States Patent
Yoon et al.

(10) Patent No.: US 9,373,280 B2
(45) Date of Patent: Jun. 21, 2016

(54) ORGANIC LIGHT EMITTING DIODE DISPLAY FOR COMPENSATING IMAGE DATA AND METHOD OF DRIVING THE SAME

(71) Applicant: LG DISPLAY CO., LTD., Seoul (KR)

(72) Inventors: Joong-Sun Yoon, Paju-si (KR); Young-Hak Lee, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 60 days.

(21) Appl. No.: 14/107,919

(22) Filed: Dec. 16, 2013

(65) Prior Publication Data

US 2014/0176625 A1 Jun. 26, 2014

(30) Foreign Application Priority Data

Dec. 21, 2012 (KR) ..... 10-2012-0150705

(51) Int. Cl.
*G09G 3/32* (2006.01)

(52) U.S. Cl.
CPC ..... *G09G 3/3233* (2013.01); *G09G 2300/0819* (2013.01); *G09G 2320/045* (2013.01); *G09G 2360/16* (2013.01)

(58) Field of Classification Search
CPC ... G09G 3/3233; G09G 3/325; G09G 3/3258; G09G 3/3275; G09G 3/3291; G09G 2300/0819; G09G 2300/0861; G09G 2300/0866; G09G 2310/027; G09G 2320/0233; G09G 2320/0271; G09G 2320/0276; G09G 2320/043; G09G 2320/045; G09G 2320/0295; G09G 2360/16
See application file for complete search history.

(56) References Cited

U.S. PATENT DOCUMENTS

| | | | | |
|---|---|---|---|---|
| 2007/0126672 | A1* | 6/2007 | Tada et al. | 345/77 |
| 2009/0140959 | A1 | 6/2009 | Nam et al. | |
| 2009/0256854 | A1* | 10/2009 | Mizukoshi et al. | 345/589 |
| 2010/0103082 | A1 | 4/2010 | Levey et al. | |
| 2010/0134469 | A1* | 6/2010 | Ogura et al. | 345/211 |
| 2010/0188320 | A1* | 7/2010 | Min et al. | 345/80 |
| 2010/0194769 | A1* | 8/2010 | Mori | 345/589 |
| 2010/0214273 | A1 | 8/2010 | Shirouzu et al. | |
| 2011/0122119 | A1* | 5/2011 | Bae et al. | 345/211 |
| 2011/0199395 | A1* | 8/2011 | Nathan et al. | 345/690 |
| 2011/0216056 | A1* | 9/2011 | Yoo et al. | 345/212 |
| 2011/0254878 | A1* | 10/2011 | Mori et al. | 345/690 |
| 2012/0154460 | A1 | 6/2012 | Segawa et al. | |
| 2012/0306947 | A1* | 12/2012 | Kim et al. | 345/694 |

FOREIGN PATENT DOCUMENTS

| | | | |
|---|---|---|---|
| CN | 101430862 | A | 5/2009 |
| CN | 102203846 | A | 9/2011 |
| CN | 102272819 | A | 12/2011 |

* cited by examiner

*Primary Examiner* — Keith Crawley
(74) *Attorney, Agent, or Firm* — Birch, Stewart, Kolasch & Birch, LLP

(57) ABSTRACT

An organic light emitting diode (OLED) display device and a method of driving the same are discussed. The method includes sensing a threshold voltage and mobility of a driving thin film transistor (TFT) included in each pixel using a sensing line connected per pixel and supplying the threshold voltage and the mobility to a timing controller in a measurement mode, by a data driver, and supplying image data input from an external source to the data driver by a timing controller, the timing controller adding and multiplying an offset value and gain value corresponding to the threshold voltage and mobility of the driving TFT, sensed by the data driver in the measurement mode, with the image data to compensate the image data, wherein the compensation of the image data includes varying a weight of the gain value according to luminance of the image data.

5 Claims, 13 Drawing Sheets

ORGANIC LIGHT EMITTING DIODE DISPLAY FOR COMPENSATING IMAGE DATA AND METHOD OF DRIVING THE SAME

This application claims the benefit of Korean Patent Application No. 10-2012-0150705, filed on Dec. 21, 2012, which is hereby incorporated by reference as if fully set forth herein.

BACKGROUND OF THE INVENTION

1. Field of the Invention

The present invention relates to an organic light emitting diode (OLED) display device and a method of driving the same.

2. Discussion of the Related Art

Each of a plurality of pixels included in an organic light emitting diode (OLED) display device includes an OLED including an organic light emitting layer between an anode and a cathode, and a pixel circuit for independently driving the OLED. The pixel circuit primarily includes a switching thin film transistor (TFT), a capacitor, and a driving TFT. The switching TFT charges the capacitor with a data voltage in response to a scan pulse and controls a current amount supplied to the OLED according to the data voltage charged in the driving TFT to adjust a light emitting amount of the OLED.

However, in the OLED display device, the characteristics such as threshold voltage Vth and mobility of a driving TFT may be different per pixel due to process deviation and so on and thus, current amounts for driving the OLEDs are different, thereby causing luminance deviation between pixels. In general, problems arise in that a characteristic difference of an initial driving TFT causes display spots or patterns and a characteristic difference caused by degradation in the driving TFT during driving of the OLED reduces a lifespan of an OLED display panel or generates an afterimage.

To overcome these problems, a timing controller senses a threshold voltage and mobility of a driving TFT of each pixel using a data driver and compensates data supplied to each pixel according to the sensed threshold voltage and mobility of the driving TFT, which has been introduced before. However, problems arise in that, when a compensation data voltage is calculated using this method, if the calculated compensation data voltage exceeds a maximum voltage that can be driven by the data driver, it is difficult to compensate data.

SUMMARY OF THE INVENTION

Accordingly, the present invention is directed to an organic light emitting diode (OLED) display device and a method of driving the same that substantially obviate one or more problems due to limitations and disadvantages of the related art.

An object of the present invention is to provide an OLED display device and a method of driving the same, by which a voltage margin for compensating for characteristic deviation is ensured by a data driver, thereby improving reliability and image quality.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an OLED display device includes a display panel including a plurality of pixels, each including a light emitting device and a driving thin film transistor (TFT) for supplying driving current to the light emitting device, a gate driver for driving gate lines connected to each pixel, a data driver for sensing a threshold voltage and mobility of the driving TFT using a sensing line connected to each pixel in a measurement mode, and applying a data voltage to data lines connected to each pixel in a display mode, a timing controller for sorting image data input from an external source and supplying the image data to the data driver in the display mode; wherein the timing controller adds and multiplies an offset value and gain value to the image data so as to compensate the image data, wherein the offset value and gain value are sensed by the data driver and correspond to the threshold voltage and mobility of the driving TFT, wherein the timing controller varies a weight of the gain value according to luminance of the image data.

The timing controller may include an average picture level (APL) detector for analyzing the image data input thereto on a frame basis to calculate an APL, a peak luminance controller for controlling peak luminance per frame according to the APL provided from the APL detector, and a data compensator for calculating the offset value and the gain value from the threshold voltage and mobility of the driving TFT, supplied from the data driver, multiplying the image data and the calculated gain value and then adding the calculated offset value to a result value to compensate the image data, and varying the weight of the gain value according to the APL supplied from the APL detector while the image data is multiplied by the gain value, in the measurement mode.

The data compensator may increase the weight of the gain value as the APL increases.

The peak luminance controller may set the peak luminance to maximum luminance when the APL is 0 to a reference level and set the peak luminance to linearly decrease down to minimum luminance from the maximum luminance when the APL is the reference level to 1, and the data compensator may set the weight of the gain value to 10% or less when the APL is 0 to the reference level, and set the weight of the gain value to increase to 100% from 10% when the APL is the reference level to 1.

The weight of the gain value may have an inclination that gradually increases when the APL is the reference level to 1.

The weight of the gain value may have an inclination that gradually decreases when the APL is the reference level to 1.

The weight of the gain value may linearly increase when the APL is the reference level to 1.

The timing controller may include an APL detector for analyzing the image data input thereto on a frame basis to calculate an APL, a peak luminance controller for controlling peak luminance per frame according to the APL provided from the APL detector, and a data compensator for calculating the offset value and the gain value from the threshold voltage and mobility of the driving TFT, supplied from the data driver, multiplying the image data and the calculated gain value and then adding the calculated offset value to a result value to compensate the image data, and varying the weight of the gain value according to the peak luminance set by the peak luminance controller while the image data is multiplied by the gain value, in the measurement mode.

The data compensator may decrease the weight of the gain value as the peak luminance set by the peak luminance controller increases.

In another aspect of the present invention, a method of driving an organic light emitting diode (OLED) display device includes sensing a threshold voltage and mobility of a driving thin film transistor (TFT) included in each pixel using a sensing line connected per pixel and supplying the threshold voltage and the mobility to a timing controller in a measurement mode, by a data driver, and supplying image data input from an external source to the data driver by a timing controller, the timing controller adding and multiplying an offset value and gain value corresponding to the threshold voltage and mobility of the driving TFT, sensed by the data driver in the measurement mode, with the image data to compensate the image data, wherein the compensation of the image data includes varying a weight of the gain value according to luminance of the image data.

The compensation of the image data may include analyzing the image data input thereto on a frame basis to calculate an average picture level (APL), controlling peak luminance per frame according to the APL provided from the APL detector, and calculating the offset value and the gain value from the threshold voltage and mobility of the driving TFT, supplied from the data driver, multiplying the image data and the calculated gain value and then adding the calculated offset value to a result value to compensate the image data, and varying the weight of the gain value according to the APL supplied from the APL detector while the image data is multiplied by the gain value, in the measurement mode.

The varying of the weight of the gain value may include increasing the weight of the gain value as the APL increases.

The controlling of the peak luminance may include setting the peak luminance to maximum luminance when the APL is to a reference level, and setting the peak luminance to linearly decrease down to minimum luminance from the maximum luminance when the APL is the reference level to 1, and the varying of the weight of the gain value may include setting the weight of the gain value to 10% or less when the APL is 0 to the reference level, and setting the weight of the gain value to increase to 100% from 10% when the APL is the reference level to 1.

The compensation of the image data may include analyzing the image data input thereto on a frame basis to calculate an average picture level (APL), controlling peak luminance per frame according to the APL provided from the APL detector, and calculating the offset value and the gain value from the threshold voltage and mobility of the driving TFT, supplied from the data driver, multiplying the image data and the calculated gain value and then adding the calculated offset value to a result value to compensate the image data, and varying the weight of the gain value according to the peak luminance while the image data is multiplied by the gain value, in the measurement mode.

The varying of the weight of the gain value may include decreasing the weight of the gain value as the peak luminance is set to be higher.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
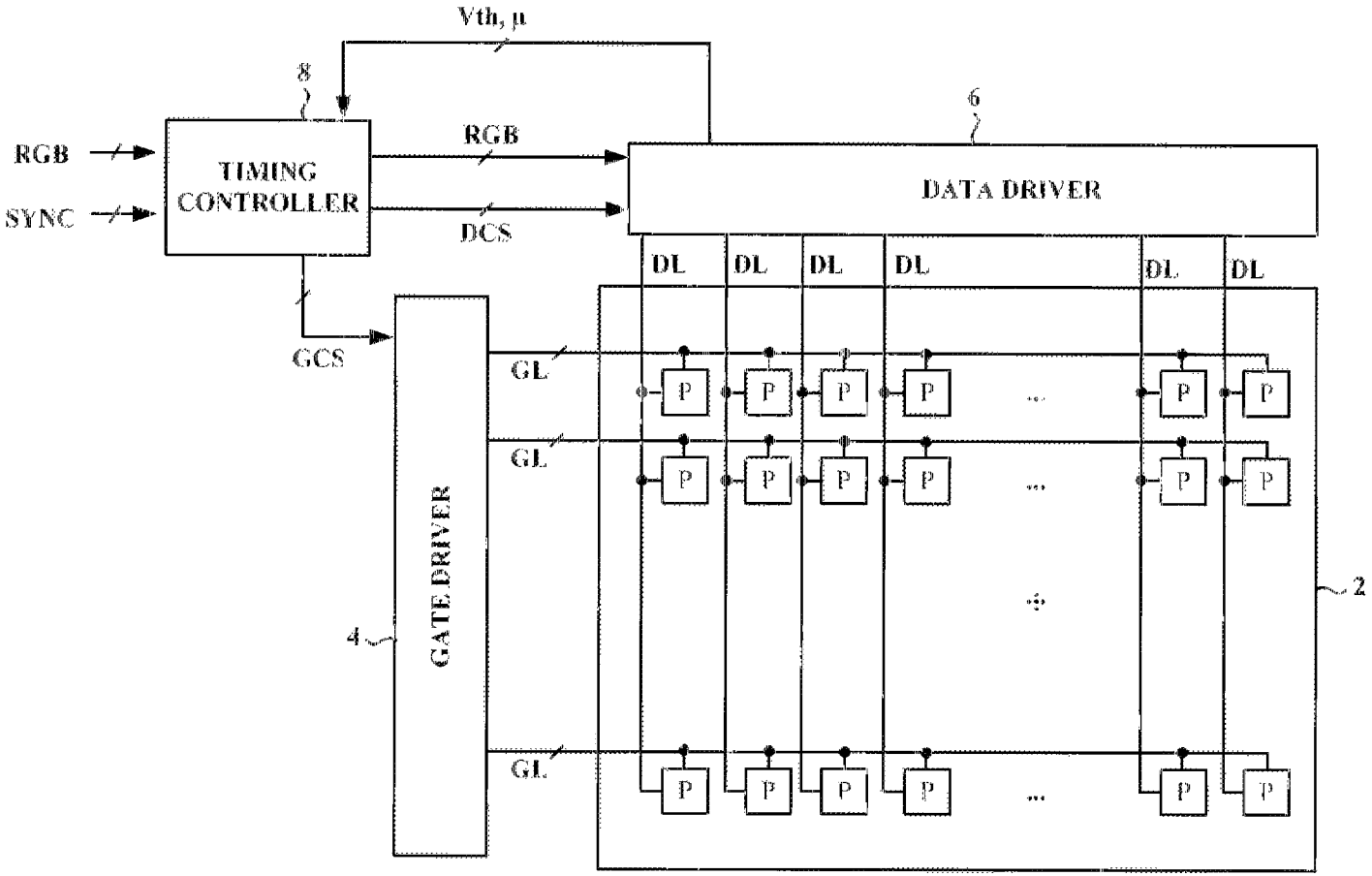
FIG. 1 is a diagram illustrating a structure of an organic light emitting diode (OLED) display device according to an embodiment of the present invention.
Figure 2:
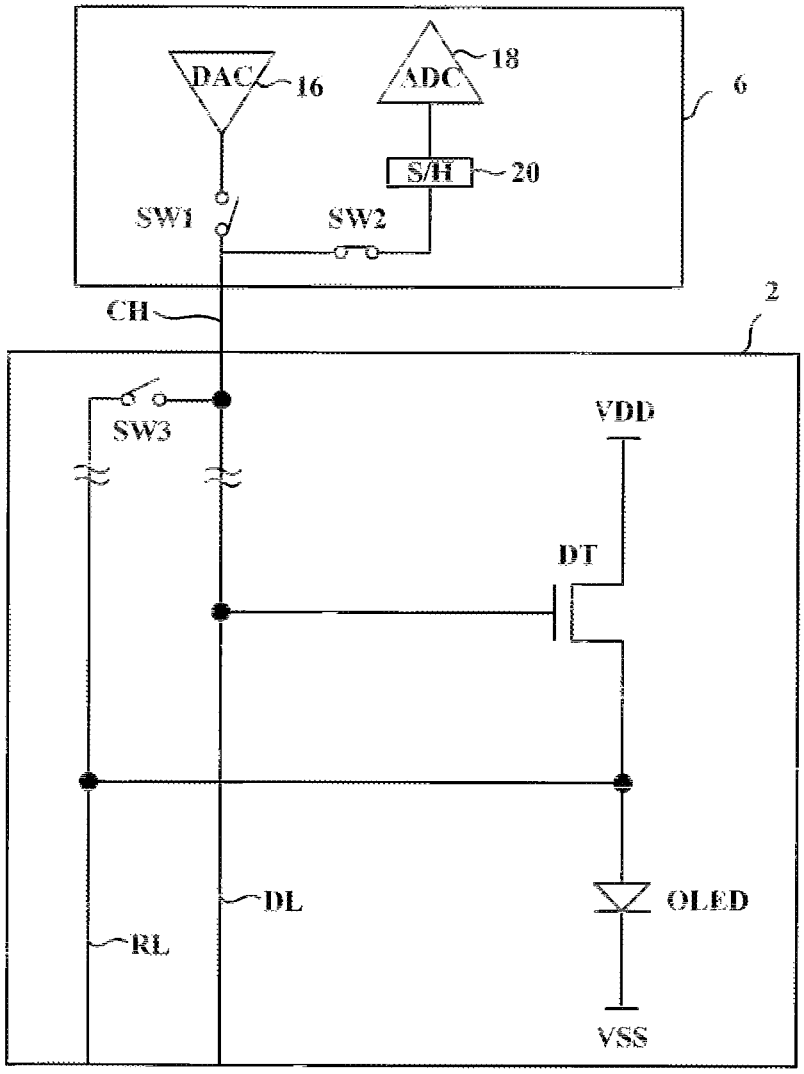
FIG. 2 is an equivalent circuit diagram illustrating a partial structure of a display panel and a data driver illustrated in FIG. 1.
Figure 3A:
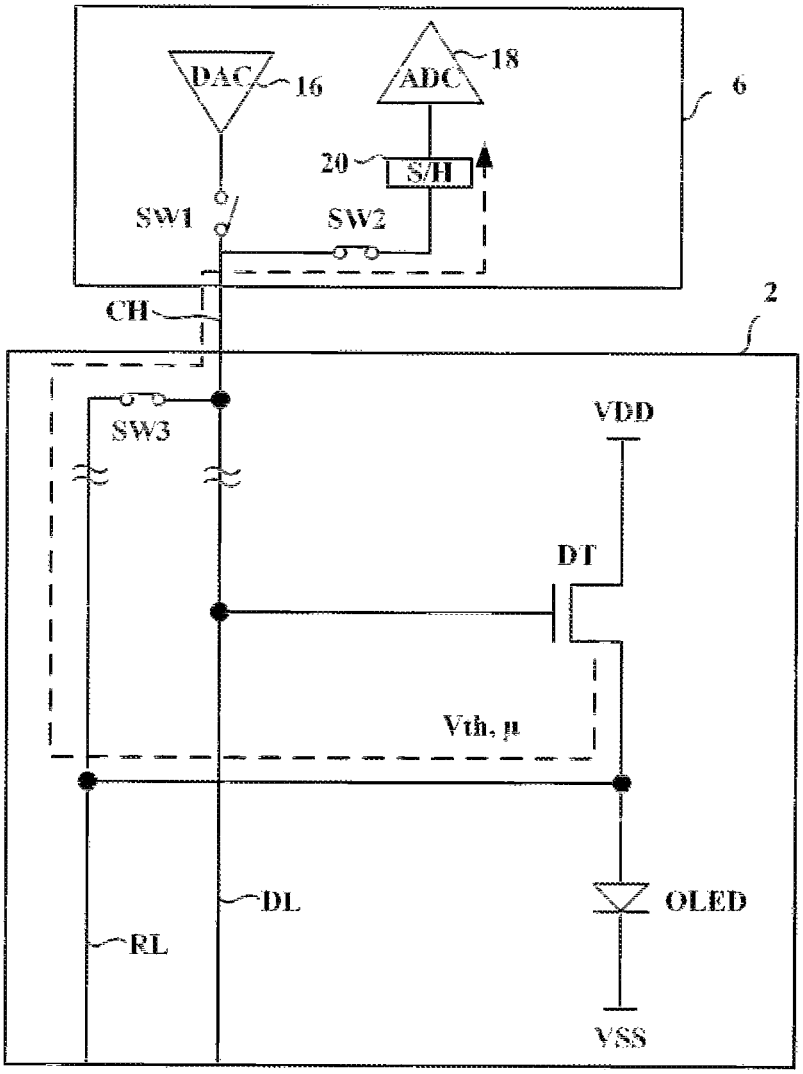
FIGS. 3A and 3B are diagrams illustrating an operation in a measurement mode and a display mode.
Figure 3B:
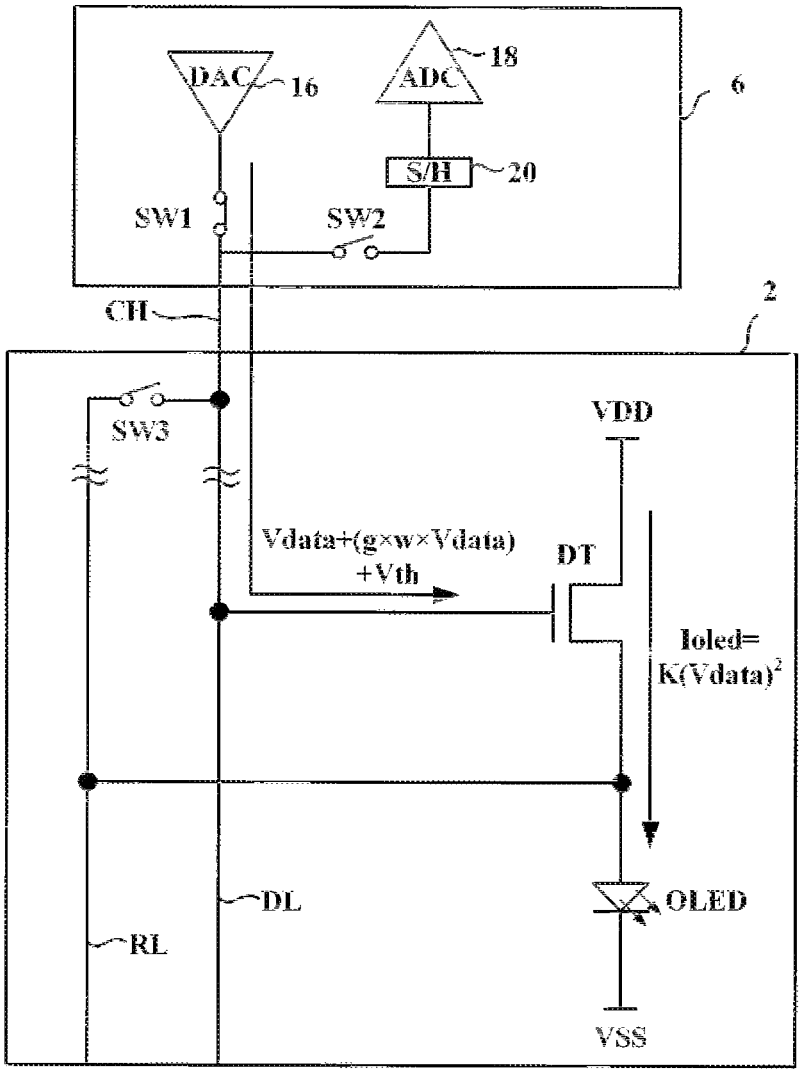

FIG. 1 is a diagram illustrating a structure of an organic light emitting diode (OLED) display device according to an embodiment of the present invention. FIG. 2 is an equivalent circuit diagram illustrating a partial structure of a display panel 2 and a data driver 6 illustrated in FIG. 1. FIGS. 3A and 3B are diagrams illustrating an operation in a measurement mode and a display mode. For convenience of description, FIGS. 2 and schematically illustrate a structure of one representative pixel P as the display panel 2 and a structure of one output channel CH and a driver connected thereto as the data driver 6.

The OLED display device illustrated in FIG. 1 includes the display panel 2 in which a plurality of gate lines GLs and a plurality of gate lines DLs intersect each other to define pixels P, a gate driver 4 for driving the plural gate lines GLs, the data driver 6 for driving the plural gate lines DLs, and a timing controller 8 for controlling the gate driver 4 and the data driver 6 by sorting image data RGB input from an external source, supplying the image data RGB acquired by compensating for a threshold voltage Vth and mobility μ of a driving thin film transistor (TFT) DT of each pixel P to the data driver 6, and outputting a gate control signal and a data control signal DCS.

The timing controller 8 according to the present invention senses the threshold voltage Vth and the mobility μ of the TFT DT using the data driver 6 in the measurement mode and adds and multiplies an offset value Vth and gain value g corresponding to the sensed threshold voltage Vth and the mobility μ by the image data RGB to compensate for the threshold voltage Vth and the mobility μ of the driving TFT(DT). In particular, according to the present invention, reliability and image quality of the OLED display device may be improved by varying a weight w of the gain value g according to luminance of the image data RGB to ensure a voltage margin for compensating for the threshold voltage Vth by the driving TFT DT, which will be described in detail with reference to FIGS. 4 to 8.

Referring to FIG. 2, the OLED display device according to the present invention may operate in distinguished modes, that is, in a measurement mode (FIG. 3A) for sensing the threshold voltage Vth and the mobility μ of the driving TFT DT and a display mode (FIG. 3B) for compensating for the threshold voltage Vth and the mobility μ of the driving TFT DT and displaying an image.

The data driver 6 includes a digital-analog converter (DAC) 16 connected per output channel CH, a sample and hold (S/H) circuit 20 connected per output channel CH, an analog-digital converter (ADC) 18 connected to an output terminal of the S/H circuit 20, a first switch SW1 connected between the DAC 16 and the output channel CH, and a second switch SW2 connected between the output channel CH and the S/H circuit 20.

Each pixel P of the display panel 2 includes an OLED and the driving TFT DT for supplying driving current to the OLED. Each pixel P is connected to the gate lines GLs, the data lines DLs, and reference voltage supply lines RLs. The reference voltage supply lines RLs may each be used as a sensing line in the measurement mode. To this end, the number of the reference voltage supply lines RLs corresponds to the number of the data lines DL, and the reference voltage supply lines RLs are connected to the output channel CH of the data driver 6 through a third switch SW3. Although not illustrated, each pixel P may include at least three TFTs and at least one capacitor. The TFTs of each pixel P is switched on or off according to scan singles supplied from the gate lines GL so as to supply the threshold voltage Vth and the mobility μ of the driving TFT DT to the data driver 6 in the measurement mode and to apply a data voltage Vdata provided from the data driver 6 to a gate electrode of the driving TFT DT in the display mode.

The DAC 16 converts input digital data into the analog data voltage Vdata and applies the data voltage Vdata to the data lines DLs through the first switch SW1.

The S/H circuit 20 measures (samples and holds) and outputs a voltage of a sensing line (i.e., the reference voltage supply lines RL) of the display panel 2 through the output channel CH and the second switch SW2.

The ADC 18 converts an analog voltage output from the S/H circuit 20 into digital data and supplies the digital data to the timing controller 8.

Referring to FIG. 3A, the OLED display device according to the present invention senses the threshold voltage Vth of the driving TFT DT in a source follow manner in the measurement mode and senses the mobility μ of the driving TFT DT by measuring an inclination of current flowing along the driving TFT DT. In addition, the data driver 6 measures the threshold voltage Vth and a voltage corresponding to the mobility μ of the driving TFT DT using the reference voltage supply line RL as a sensing line. In this case, the threshold voltage Vth and the voltage corresponding to the mobility μ of the driving TFT DT are applied to the timing controller 8 through the S/H circuit and the ADC 18. According to the present invention, the threshold voltage Vth and the mobility μ of the driving TFT DT are sensed using a conventional method and thus, the sensing method is not described here.

Referring to FIG. 3B, the OLED display device according to the present invention is configured in such a way that the timing controller 8 adds and multiplies the offset value Vth and gain value g corresponding to the threshold voltage Vth and the mobility μ of the driving TFT DT by the image data RGB, and supplies a result value to the data driver 6 in the display mode. In addition, the data driver 6 sequentially latches the image data RGB supplied from the timing controller 8 and then, the DAC 16 converts the latched data into an analog data voltage (Vdata+(g×w×Vdata)+Vth) and applies the data voltage (Vdata+(g×w×Vdata)+Vth) to the data line DL through the first switch SW1. In addition, each pixel P applies the data voltage (Vdata+(g×w×Vdata)+Vth) provided from the data line DL to a gate electrode of the driving TFT DT such that the driving TFT DT supplies current to the OLED. In this case, the data voltage (Vdata+(g×w×Vdata)+Vth) applied to the gate electrode of the driving TFT DT is a value obtained by compensating for the threshold voltage Vth and the mobility μ of the driving TFT DT. Thus, driving current supplied to the OLED through the driving TFT DT has a constant value "Ioled=K(Vdata)" obtained by compensating for deviation of the threshold voltage Vth and the mobility μ of the driving TFT DT. Here, K is a constant determined according to parasitic capacitance and the mobility μ of the driving TFT DT.

Hereinafter, a method of ensuring a voltage margin for compensating for the threshold voltage Vth of the driving TFT DT by the data driver 6 will be described in detail.

Figure 4:
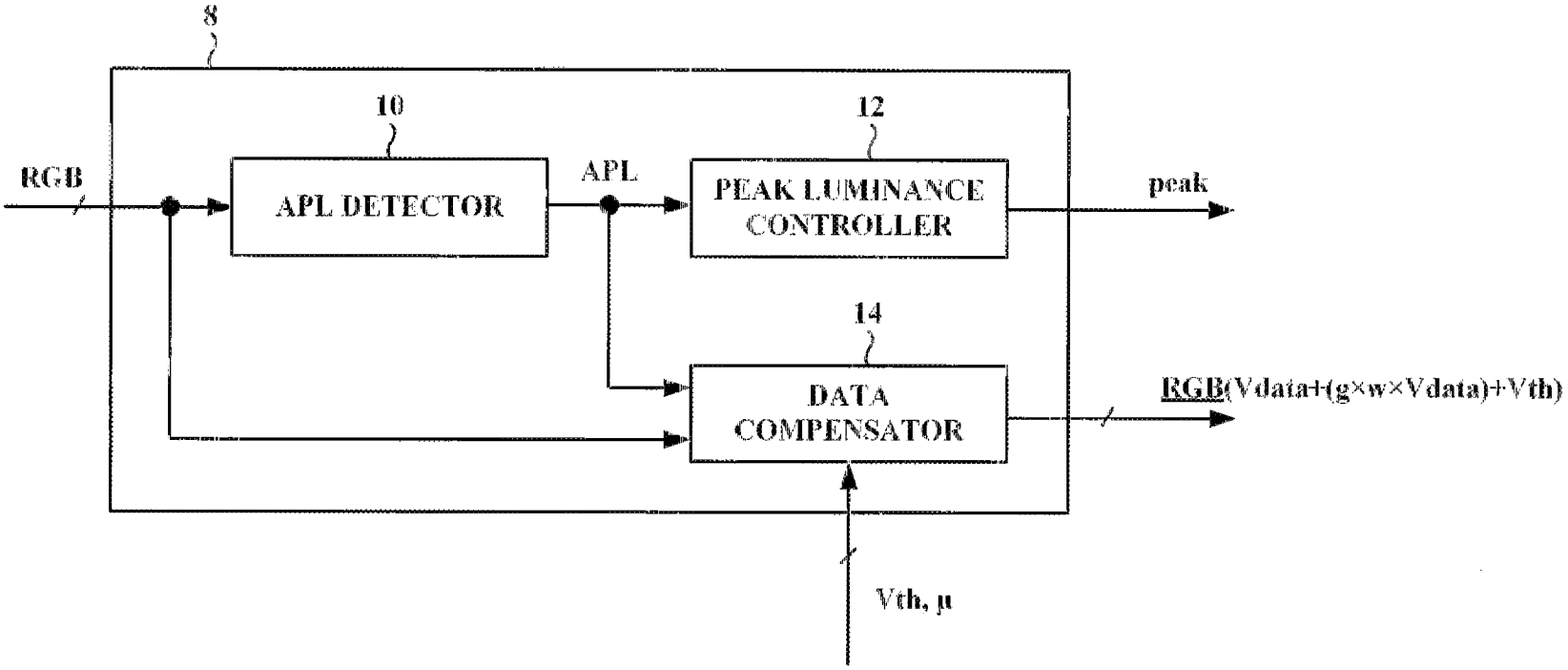
FIG. 4 is a diagram illustrating a structure of a timing controller illustrated in FIG. 1.
Figure 5:
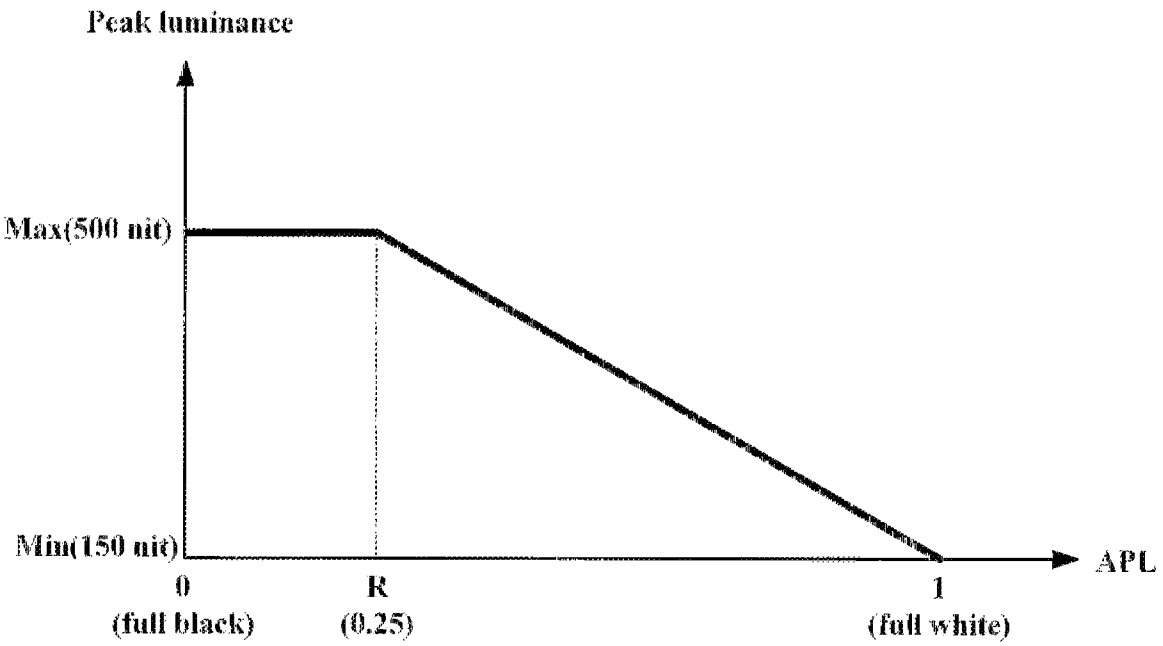
FIG. 5 is a graph illustrating an example of a peak luminance control (PLC) function.

FIG. 4 is a diagram illustrating a structure of the timing controller 8 illustrated in FIG. 1. FIG. 5 is a graph illustrating an example of a peak luminance control (PLC) function.

The timing controller 8 of FIG. 4 includes an average picture level (APL) detector 10, a peak luminance controller 12, and a data compensator 14.

The APL detector 10 analyzes the image data RGB input thereto on a frame basis to calculate an APL. The APL detector 10 calculates the APL and thus, the calculating method is not described here.

The peak luminance controller 12 determines peak luminance per frame according to the APL calculated by the APL detector 10. The peak luminance set by the peak luminance controller 12 is supplied to a gamma voltage applier to vary a maximum gamma voltage. To this end, the peak luminance controller 12 may set the peak luminance according to the PLC function illustrated in FIG. 5. That is, when the APL is in the range of 0 to a reference level R, the peak luminance controller 12 may set the peak luminance to maximum luminance Max. When the APL is in the range of the reference level R to 1, the peak luminance controller 12 may set the peak luminance to linearly decrease down to minimum luminance Min. For example, when the reference level R is 0025, the maximum brightness Max is 500 nit, and minimum luminance Mi is 150 nit in the PLC function, if the APL is in the range of 0 (full black) to 0.25, the peak brightness is set to 500 nit. In addition, when the APL is 0.25 or more, the peak luminance gradually decreases from 500 nit. When the APL reaches 1 (full white), the peak luminance is set to 150 nit. According to the present invention, the peak luminance may be varied according to the displayed image to reduce power consumption.

The data compensator 14 calculates the offset value Vth and the gain value g from the threshold voltage Vth and the mobility μ of the driving TFT DT, supplied from the data driver 6, in the measurement mode. In addition, the data compensator 14 multiplies the gain value g and the image data RGB input to the data compensator 14 and adds the offset value Vth to a result value to compensate the image data RGB. In this case, the data compensator 14 may vary the weight w of the gain value g multiplied by the image data RGB such that the data driver 6 ensures a voltage margin for compensating for the threshold voltage Vth of the driving TFT DT, which will be described below in detail.

Basically, the data compensator 14 varies the weight w of the gain value g according to the luminance of the image data RGB. This is because the data voltage Vdata increases to reduce a voltage margin for compensating for characteristic deviation of the driving TFT DT in the data driver 6 as the luminance of the image data RGB increases. Thus, according to the present invention, the data compensator 14 may vary the weight w of the gain value g according to the luminance of the image data RGB so as to ensure a voltage margin for compensating for the characteristic deviation of the driving TFT DT in the data driver 6.

Figure 6:
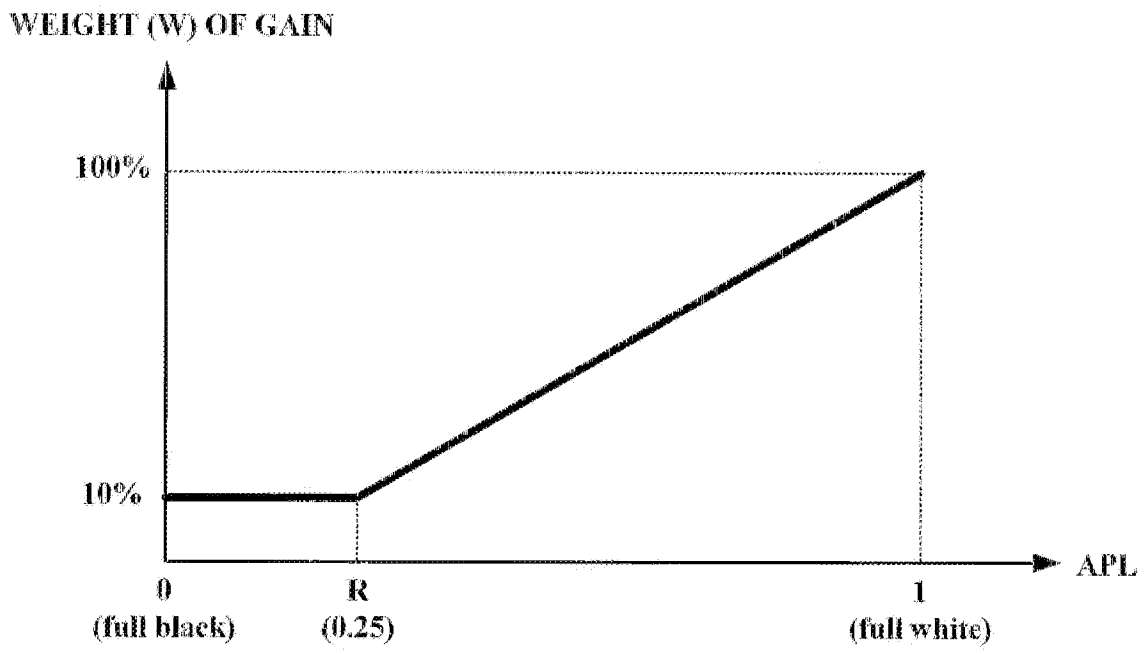
FIG. 6 is a graph illustrating a function showing a weight of a gain value according to an average picture level (APL)
Figure 7A:
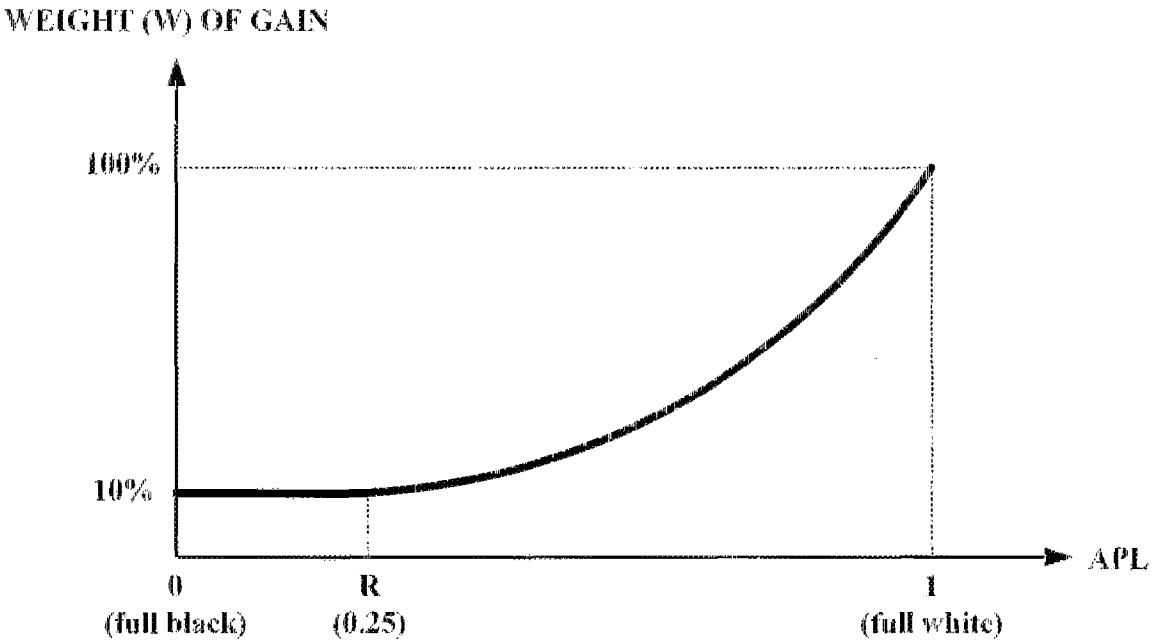
FIGS. 7A and 7B are graphs illustrating various functions showing a weight of a gain value according to an APL.
Figure 7B:
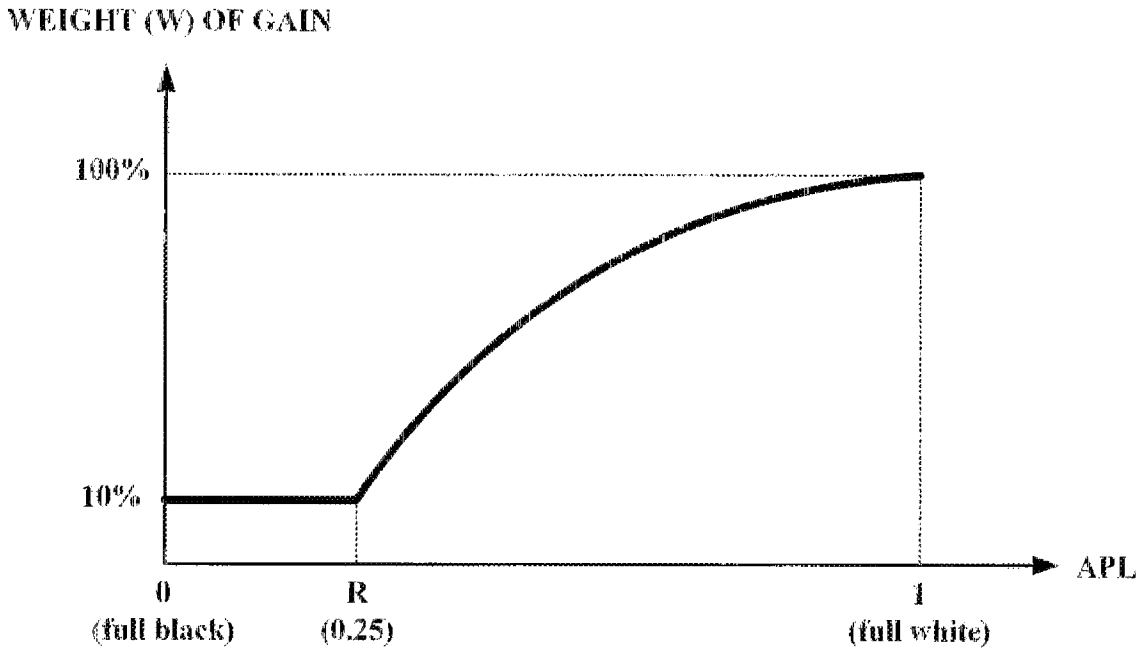

In detail, the data compensator 14 varies the weight w of the gain value g according to the APL provided from the APL detector 10. For example, as illustrated in FIG. 6, when the APL is in the range of 0 to the reference level R, the data compensator 14 may set the weight w of the gain value g to 10% or less, and when the APL is in the range of the reference level R to 1, the data compensator 14 may set the weight of the gain value g to increase to 100% from 10%. In this case, although the weight w of the gain value g linearly increases in the range of the reference level R to 1 in FIG. 6, the present invention is not limited thereto. That is, when the APL is in the range of the reference level R to 1, an inclination of the weight w of the gain value g may gradually increase as illustrated in FIG. 7A or may gradually decrease as illustrated in FIG. 7B. Accordingly, according to the present invention, since the peak luminance decreases as the APL increases, an offset voltage margin for compensating for the threshold voltage Vth of the driving TFT DT may be ensured by increasing the weight of the gain value g as the APL increases.

According to the present invention, user awareness with respect to irregular luminance is relatively low in a low gray level range in which the APL is less than the reference level R and is relatively high in a high gray level range in which the APL is close to 1 and thus, the weight w of the gain value g increases in a high gray level image, an ALP of which is close to 1 (full white), and on the other hand, the weight w of the gain value g is minimized in a low gray level image, an APL of which is close to 0 (full black), thereby ensuring an offset voltage margin for compensating for the threshold voltage Vth of the driving TFT DT.

Figure 9:
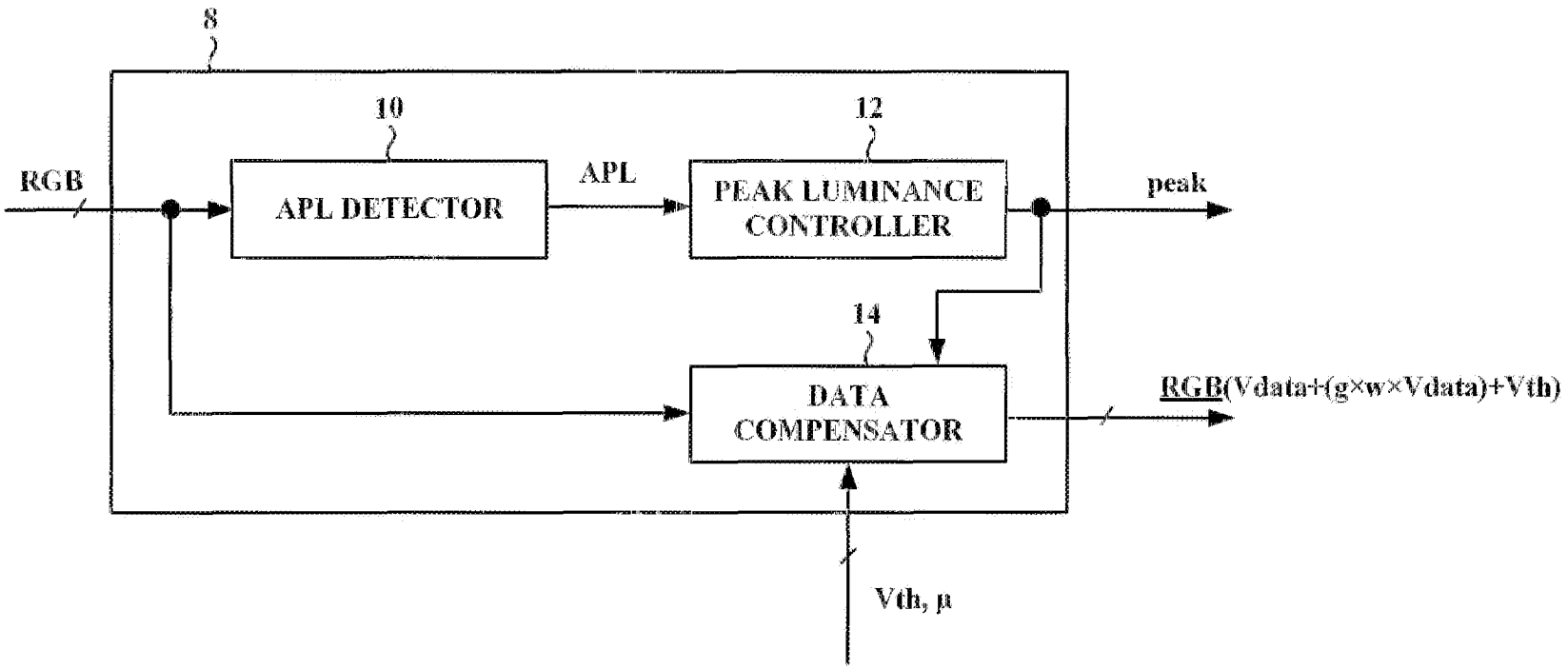
FIG. 9 is a diagram illustrating an operation of a data compensator according to another embodiment of the present invention.

As illustrated in FIG. 9, the data compensator 14 may vary the weight w of the gain value g according to the peak luminance provided from the peak luminance controller 12 instead of the APL. In the case of FIG. 9, the data compensator 14 may decrease the weight w of the gain value g as the peak luminance increases, thereby ensuring an offset voltage margin for compensating for the threshold voltage Vth of the driving TFT DT.

Hereinafter, a case in which a voltage margin for compensating for the threshold voltage Vth of the driving TFT DT is ensured by the data driver 6 by varying the weight w of the gain value g is varied will be described.

Figure 8A:
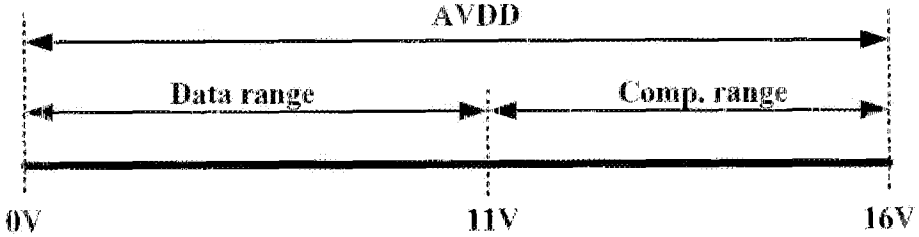
FIGS. 8A to 8C are diagram for explanation of advantages of the present invention.
Figure 8B:
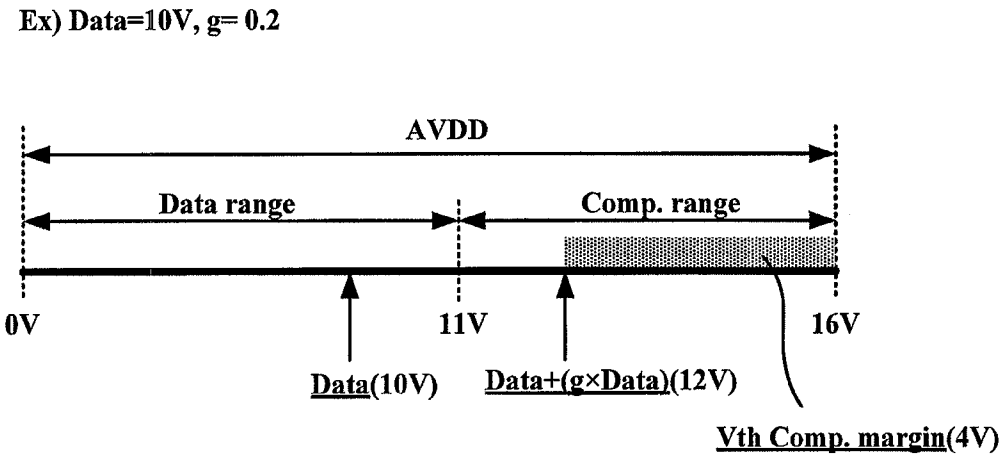
FIG. 8B Prior Art
Figure 8C:
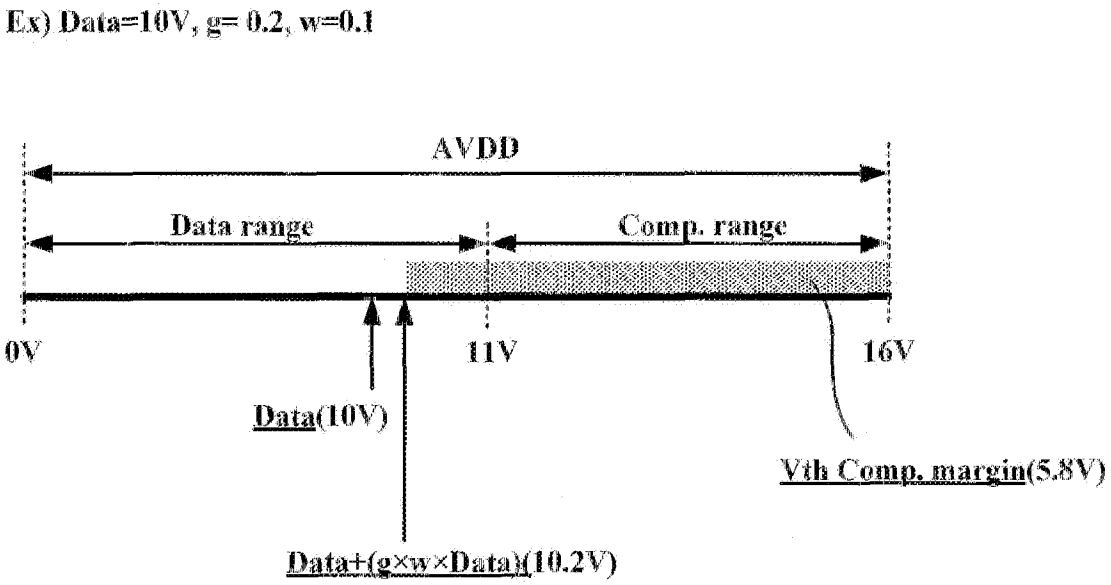

FIGS. 8A to 8C are diagram for explanation of advantages of the present invention.

First, as illustrated in FIG. 8A, it is assumed that a maximum voltage AVDD that can be driven by a data driver is 16 V and a data range to which a data voltage Vdata is allocated is 0 V to 11 V. In this case, a remaining range except for the data region, that is, 11 V to 16 V is a compensating region for compensating for the threshold voltage Vth and the mobility μ of the driving TFT DT.

However, according to the conventional art as illustrated in FIG. 8B, when an input data voltage data Vdata is set to 10 V and the gain value g according to the mobility μ of the driving TFT DT is 0.2, a data voltage multiplied by the gain value g is 12 V as "Data+(g×Data)". Thus, an offset voltage margin according to the threshold voltage Vth of the driving TFT DT is in the range of 12 V to 16 V, corresponding to 4 V.

On the other hand, as illustrated in FIG. 8C, according to the present invention, when the input data voltage data Vdata is set to 10 V, the gain value g according to the mobility μ of the driving TFT DT is 0.2, and the weight w of the gain value g is 0.1, a data voltage multiplied by the gain value g is 10.2 V as "Data+(g×w×Data)". Accordingly, an offset voltage margin according to the threshold voltage Vth of the driving TFT DT is in the range of 10.2 V to 16V, corresponding to 5.8 V.

Accordingly, when the input data voltage Vdata is set to 10 V and the gain value g according to the mobility μ of the driving TFT DT is 0.2, according to the conventional art, an offset voltage margin according to the threshold voltage Vth of the driving TFT DT is 4V, and on the other hand, according to the present invention, it can be seen that the offset voltage margin increases to 5.8 V.

As described above, according to the present invention, the weight w of the gain value g may vary according to luminance of the image data RGB to ensure a voltage margin for compensating for the threshold voltage Vth of the driving TFT DT by the data driver 6, thereby improving reliability and image quality.

According to the present invention, a weight of a gain value may vary according to luminance of image data to ensure a voltage margin for compensating for a threshold voltage of a driving TFT by a data driver, thereby improving reliability and image quality.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting diode (OLED) display device comprising:

a display panel comprising a plurality of pixels, each comprising a light emitting device and a driving thin film transistor (TFT) for supplying driving current to the light emitting device;

a gate driver for driving gate lines connected to each pixel;

a data driver for sensing a threshold voltage and a mobility of the driving TFT using a sensing line connected to each pixel in a measurement mode, and applying a data voltage to data lines connected to each pixel in a display mode; and a timing controller for sorting image data input from an external source and supplying the image data to the data driver in the display mode, wherein the timing controller comprises:

an average picture level (APL) detector for analyzing the image data input thereto on a frame basis to calculate an APL;

a peak luminance controller for controlling a peak luminance per frame according to the APL provided from the APL detector; and a data compensator for calculating an offset value and a gain value from the threshold voltage and the mobility of the driving TFT, supplied from the data driver, multiplying the image data and the calculated gain value and then adding the calculated offset value to a result value to compensate the image data, and varying a weight of the gain value according to the APL supplied from the APL detector while the image data is multiplied by the gain value, in the measurement mode, and wherein:

the peak luminance controller sets the peak luminance to a maximum luminance when the APL is 0 to a reference level and sets the peak luminance to decrease down to a minimum luminance from the maximum luminance when the APL is the reference level to 1; and the data compensator sets the weight of the gain value to a first percentage of a maximum gain value or less when the APL is 0 to the reference level, and sets the weight of the gain value to increase to the maximum gain value from the first percentage of the maximum gain value when the APL is the reference level to 1.

2. The OLED display device according to claim 1, wherein the weight of the gain value has an inclination that gradually increases when the APL is the reference level to 1.

3. The OLED display device according to claim 1, wherein the weight of the gain value has an inclination that gradually decreases when the APL is the reference level to 1.

4. The OLED display device according to claim 1, wherein the weight of the gain value linearly increases when the APL is the reference level to 1.

5. A method of driving an organic light emitting diode (OLED) display device, the method comprising:

sensing a threshold voltage and a mobility of a driving thin film transistor (TFT) included in each pixel using a sensing line connected per pixel and supplying the threshold voltage and the mobility to a timing controller in a measurement mode, by a data driver;

supplying image data input from an external source to the data driver by the timing controller;

analyzing the image data input thereto on a frame basis to calculate an average picture level (APL);

controlling a peak luminance per frame according to the APL; and calculating an offset value and a gain value from the threshold voltage and the mobility of the driving TFT, supplied from the data driver, multiplying the image data and the calculated gain value and then adding the calculated offset value to a result value to compensate the image data, and varying a weight of the gain value according to the APL while the image data is multiplied by the gain value, in the measurement mode, wherein:

the controlling of the peak luminance comprises setting the peak luminance to a maximum luminance when the APL is 0 to a reference level, and setting the peak luminance to decrease down to a minimum luminance from the maximum luminance when the APL is the reference level to 1; and the varying of the weight of the gain value comprises setting the weight of the gain value to a first percentage of a maximum gain value or less when the APL is 0 to the reference level, and setting the weight of the gain value to increase to the maximum gain value from the first percentage of the maximum gain value when the APL is the reference level to 1.

* * * * *